428-134

9/16/86 OR 4,612,226

SR

United States Patent [19]

Kennette et al.

[11] Patent Number: 4,612,226

[45] Date of Patent: Sep. 16, 1986

[54] FABRIC HAVING EXCELLENT WIPING PROPERTIES

[75] Inventors: John W. Kennette, Somerville; Conrad C. Buyofsky, South River; Alton H. Bassett, Princeton, all of N.J.

[73] Assignee: Chicopee, New Brunswick, N.J.

[21] Appl. No.: 602,877

[22] Filed: Apr. 23, 1984

Related U.S. Application Data

[63] Continuation-in-part of Ser. No. 341,924, Jan. 22, 1982, abandoned.

[51] Int. Cl.[4] ..... B32B 3/10

[52] U.S. Cl. ..... 428/134; 428/131; 428/222; 428/224; 428/913

[58] Field of Search ..... 28/104; 428/137, 195, 428/222, 224, 913, 134

[56] References Cited

U.S. PATENT DOCUMENTS

| | | | |
|---|---|---|---|
| 3,081,514 | 3/1963 | Griswold | 428/134 |
| 3,081,515 | 3/1963 | Griswold et al. | 428/134 |
| 3,485,706 | 12/1964 | Evans | 428/134 |

*Primary Examiner*—James J. Bell

*Attorney, Agent, or Firm*—Nancy A. Bird

[57] ABSTRACT

The invention relates to a nonwoven fabric having a valuable combination of properties that makes the fabric particularly useful as a wiping cloth.

5 Claims, 10 Drawing Figures

FABRIC HAVING EXCELLENT WIPING PROPERTIES

This application is a continuation-in-part application of application Ser. No. 341,924, filed Jan. 22, 1982 now abandoned.

BACKGROUND OF THE INVENTION

Wiping surfaces of aqueous liquids is an activity practiced by virtually everyone, whether at home, at play; or at work. Among the properties desired of a cloth used for wiping aqueous liquids are the following:

(a) Sufficient capacity to be able to retain a reasonable quantity of liquid;

(b) Adequate take-up rate so that spills can be wiped up within a reasonable period of time;

(c) Ability to pick up liquid while leaving little or no residue;

(d) Abrasion resistance appropriate to the end-use intended for the fabric;

(e) Fabric-like softness or hand so that the cloth is comfortable to handle;

(f) Economy (i.e., low cost per use); and (g) In a cloth having re-use capabilities, resistance to staining by foods, grease, and the like.

This invention is directed to a nonwoven fabric that has these properties.

BRIEF SUMMARY OF THE INVENTION

The fabric of the invention comprises a substantially isotropic web of lightly entangled rayon staple fibers containing a small amount of adhesive binder substantially uniformly distributed throughout said web, the amount of said binder being sufficient to resist wet collapse of said web, wherein the fabric has an excellent balance of wiping properties, abrasion resistance, resistance to staining, and softness or handle characteristics.

THE PRIOR ART

Brooks, in published British patent application No. 2,045,825A, Nov. 5, 1980, discloses, in Control Example 2, Run 1, a substantially isotropic web composed of lightly entangled rayon staple fibers containing about 26 weight percent, based on fibers plus binder, of adhesive binder distributed in an intermittent pattern.

U.S. Pat. No. 4,109,353 discloses an apertured entangled fabric made by a process utilizing liquid and an ultrasonic horn. Regions of entangling occur at the perimeter of the apertures, however, the remaining fabric has no regularized structure of intersecting untangled bands of fibers entangled at the intersections.

DETAILED DESCRIPTION OF THE INVENTION

Figure 1:
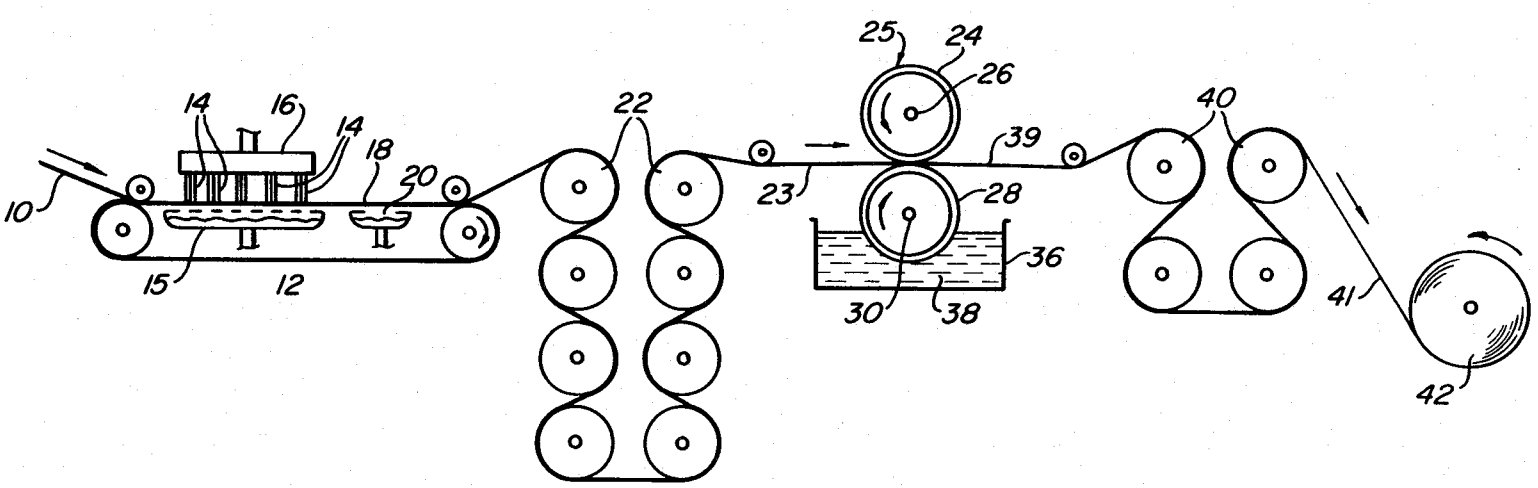
FIG. 1 is a schematic side elevation of one form of apparatus suitable for producing the fabrics of the invention.

Referring first to FIG. 1, a random laid web 10 of rayon staple fibers is passed onto a liquid pervious support member, such as an endless woven belt 12. The belt 12 carries the web of fibers 10 under a series of high pressure, fine, essentially columnar jets of water 14. The high pressure water is supplied from a manifold 16. The jets 14 are arranged in rows disposed transversely across the path of travel of the belt 12. Preferably, there is a vacuum means 15 pulling a vacuum of e.g., up to 5 to 10 inches of mercury, beneath the belt 12, with a vacuum slot positioned directly under each row of jets 14. The fibers in the web 10 are rearranged and entangled by the jets 14 as the liquid from the jets 14 passes through the fibrous web 10 and then through the belt 12. The web 18 is carried by the belt 12 over a vacuum dewatering station 20, and then proceeds to a series of drying cans 22.

Evans, in U.S. Pat. No. 3,485,706, describes a process and apparatus for rearranging/entangling fibrous webs by carrying such webs on a woven belt under a series of high pressure, fine, columnar jets of liquid. Apparatus of the general type disclosed by Evans can be used in the process of this invention, although typically the degree of entanglement contemplated by this invention is much less than that generally preferred by Evans.

The degree of fiber entanglement contemplated by this invention is preferably that obtained by the use of jet pressures of from about 200 to about 700 psi, and up to about 20 to 25 rows of orifices, with the orifices being spaced such that there are about 30 to 50 per linear inch. The orifices are usually about 0.005 to 0.007 inch in diameter. The web is usually positioned about ½ to 1½ inches below the orifices. With web speeds of from about 8 to about 100 yards per minute, fibrous webs of from about ½ to about 5 ounces per square yard are conveniently processed.

The Examples below illustrate typical conditions. Selection of conditions in specific cases is dependent upon a number of interrelated factors. For instance, heavier webs usually require more energy to entangle, and therefore usually require higher pressure and/or more rows of orifices. Also, the number of rows of orifices required is directly related to the web speeds. Thus, slower web speeds (as illustrated in the Examples) require only a few rows of orifices, while faster speeds require more rows of orifices. It is within the skill of the art to select specific entangling conditions for specific cases. As a general rule, the pressure is maintained between about 500 and 700 psi, and adjustments are made to web speed and/or number of rows of orifices to control the degree of entangling.

After the fibrous web 23 has been entangled and then dried by the drying cans 22, the dried web 23 proceeds to a bonding station 25 wherein an aqueous resin binder composition is applied uniformly to the dried web 23, as by a padder (shown schematically in FIG. 1).

The padder includes an adjustable upper rotatable top roll 24 mounted on a rotatable shaft 26, in light pressure contact, or stopped to provide a 1 or 2 mil gap between the rolls, with a lower pick-up roll 28 mounted on a rotatable shaft 30. The lower pick-up roll 28 is partially immersed in a bath 36 of aqueous resin binder composition 38. The pick-up roll 28 has a smooth rubber surface and the top roll 24 has a steel surface, which may be smooth or engraved. The pick-up roll 28 picks up resin binder composition 38 and transfers it to the web 23 at the nip between the two rolls 24,28.

After the web has passed through the padder 25, the binder-containing web 39 is then subjected to elevated temperature, as by passing around a set of drying cans 40, to dry and/or cure the resin binder, and the web 41 containing the driec and/or cured binder is then collected, as on a conventional wind-up 42.

It is not essential to dry the web prior to the application of binder, as was described above. However, unless the vacuum de-watering is quite efficient, better control over the binder application is obtained by drying the web before applying binder because there is less dilution of binder and less migration of binder to the surface of the web during drying.

The fibers used in the invention are rayon staple fibers, i.e., rayon fibers having lengths of at least one-half inch up to about three inches. Some of the rayon fibers can be replaced with other fibers such as polyester staple fibers. However, the fibers used are predominantly rayon, e.g., at least about 70 weight percent rayon and preferably at least 80 weight percent rayon.

The resin binder composition can be the conventional aqueous latex compositions, such as acrylic latexes, polyvinyl acetate latexes, ethylene-vinyl acetate latexes, carboxylated styrene-butadiene rubber latexes, or the like. Acrylic latex binders are preferred for maximum resistance to staining. One important difference compared with conventional procedures is that the resin binder composition will usually be quite dilute, e.g., from about ½ to about 5 weight percent solids, when applied by padding or dipping onto a dry web. Slightly higher solids may be needed when applying to a wet web.

The amount of resin binder employed is a small amount, e.g., up to about 10 weight percent, based on weight of fibers plus binder. The minimum amount is that amount that is sufficient to impart wet collapse resistance to the fabric. The exact amount used will depend, to a degree, on factors such as weight of fabric, presence or absence of polyester, polypropylene, or other water-resistant fibers (when polyester fibers are used, the amount of binder can be slightly less), exact end use intended, and the like. The amount of binder used will usually be within the range of from about 0.8 to about 10 weight percent, based on fibers plus binder.

An important feature of the fabrics of the invention is that they are relatively isotropic, that is, their tensile strengths are not more than about three, and preferably about two, times their tensile strengths in the cross direction. Such isotropicity is obtained by employing a random laid web as the starting web 10. Thus, the starting web can be produced by air laying by known procedures, as by using a "Rando Webber" or a dual rotor as disclosed in U.S. Pat. Nos. 3,963,392; 3,768,118; 3,740,797; 3,772,730; and 3,895,089.

The fabrics of the invention are relatively bulky, which enhances their absorbent capacities. Their bulk densities are usually within the range of from about 0.07 to about 0.13 grams/cc.

The examples below illustrate the invention:

EXAMPLE 1

Avtex SN1913, 1.5 denier, 1⅛ inch staple rayon was processed through an opener/blender and fed to a random air laying unit, which deposited a 800±15% grains per square yead web onto a forming belt woven of 0.0157 - inch diameter polyester monofilaments. It is a dual layer fabric having two superimposed layers each having 42 warp monofilaments per inch, and 32 shute monofilaments per inch woven through the warp monofilaments in the following repeating pattern: under two, between the two, over two, between the two, etc. It is available commercially from Appleton Wire Division of Albany International as Type 5710 Duotex polyester belt.

Using an apparatus similar to that shown in FIG. 1, the web was passed under a water weir to wet the fiber, and was then carried at a speed of 23 yards per minute under 12 orifice strips, each of which contained a row of holes, 50 holes per inch, of 0.005 inch diameter. Water, at 120° F., was jetted through the holes in the orifice strips at 100 psi for the first three strips and 600 psi for the remainder.

The web was dewatered by passing over a vacuum slot, and then passed over two stacks of steam cans to dry it. The stacks of steam cans were operated at 90 psi and 85 psi steam pressure, respectively.

The dried web was then run through a padder similar to the one shown in the FIG. 1, and the following binder formulation was impregnated in the web:

TABLE I

| Component | Weight |
|---|---|
| Water | 360 Pounds |
| Acrylic Resin Latex(1) | 30 Pounds |
| Antifoam agent (Y-30) | 0.1 Pounds |
| Wetting agent (NS-5199) | 1.4 Pound |
| Diammonium Phosphate | 54 Grams |
| Ammonia to pH 7–8 | As Required |

(1)National Starch 4260, 51% solids

There is about 190 weight percent wet pick-up in the padder, based on weight of fibers. The web containing the binder composition was then passed over two stacks of drying cans, operated at 60 and 98 psi, respectively.

The finished fabric had a binder content of about 7.5 weight percent, based on weight of fibers plus binder, and a grain weight of about 875 grains per square yard. Representative properties of this fabric, and properties of the fabric of Example 2, are displayed below in Table III.

EXAMPLE 2

By a procedure analogous to that described in Example 1, a mixture of 88 weight percent Avtex SN1913 rayon staple fibers and 12 weight percent Celanese Fortrel Type 310, 1.5 denier, 1½ inch staple polyester, was processed through an opener/blender and fed to a random air laying unit, which deposited a web having a grain weight of 866±15% per square yard onto a forming belt. The forming belt was woven of 0.040 inch polyester monofilaments in a plain 1×1 single layer weave, having 6 warps per inch and 6 shutes per inch. The belt had an open area of 57.8 percent.

The processing conditions under the water jets were the same as in Example 1. After dewatering, the entangled web was passed over two stacks of steam cans operated at 40 psi.

The dried web was then rum through a padder similar to that shown in FIG. 1, and the following binder formulation was impregnated in the web:

TABLE II

| Component | Weight |
|---|---|
| Water | 380 pounds |
| NS 4260 Acrylic Latex | 3.9 pounds |
| Antifoam Agent (581-B)(2) | 0.2 pounds |
| Deceresol O.T. Spec.(3) | 1.4 pounds |
| Diammonium Phosphate | 0.15 gram |
| Pigment - Inmont Yellow N2G 9883 | 0.33 pound |
| Ammonia to pH 7-8 | As required |

(2)581-B antifoam is a silicone oil.

(3)Deceresol O.T. Spec. is a surfactant (rewetting agent).

The wet pick-up of the binder composition is 200 weight percent, based on weight of fibers. The web containing the binder composition was then passed over two stacks of drying cans, the first stack of which was operated at increasing pressures of 20 to 60 psi, and the second at 90 psi.

The finished fabric had a binder content of about 1 weight percent, based on weight of fibers plus binder, and a grain weight of about 875 grains per square yard.

Figure 2:
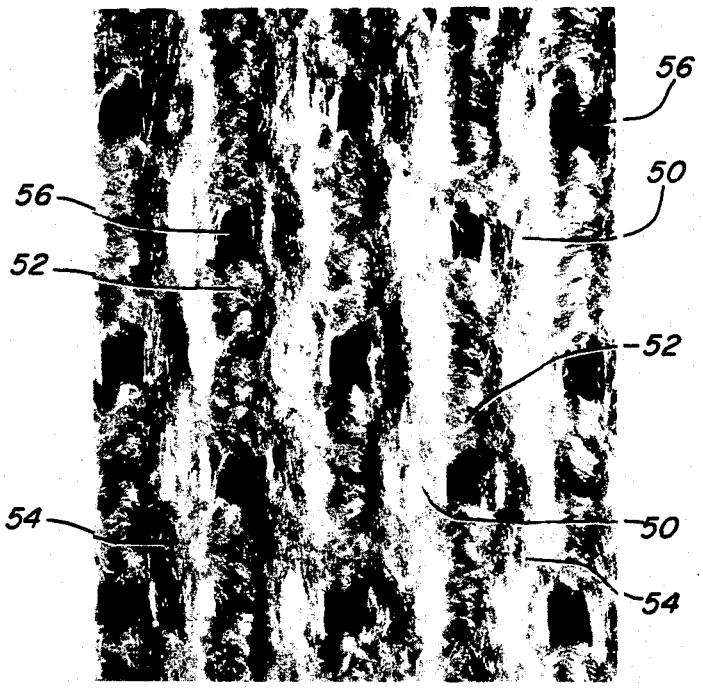
FIG. 2 is a photomacrograph, originally taken at 5× with incident light, of one preferred fabric of the invention (the fabric of Example 2)
Figure 3:
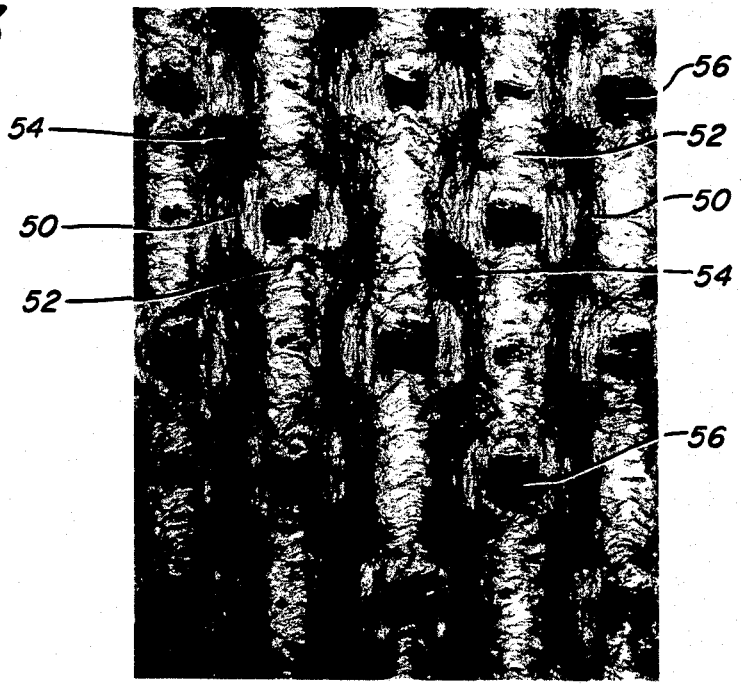
FIG. 3 is a photomacrograph similar to FIG. 2, except that it was taken with transmitted light.

This Example 2 illustrates one preferred fabric of the invention. This fabric is shown in FIGS. 2 and 3. It is characterized by two series of bands 50 and 52 that are substantially perpendicular to each other. As seen most clearly in FIG. 3, each band in both series contains segments in which the individual fibers are all substantially parallel to each other, which segments alternate with regions 54 in which the fibers are randomly entangled. These regions 54 occur where an individual band of one series 50 intersects an individual band of the other series 52. Also, at regularly spaced intervals between the individual bands of both of said series of bands 50 and 52, there are openings or holes 56 in the fabric.

This preferred fabric of the invention is produced by a procedure analogous to that described in Example 1, the significant feature being the forming belt. The forming belt is a single layer, plain weave belt woven of monofilaments.

Table III, below displays representative physical properties of the fabrics of Examples 1 and 2.

TABLE III

| Property | Example 1 | Example 2 |
|---|---|---|
| Weight, grains/yd$^2$ | 875 | 875 |
| Softness(1), grams | 65 | 25 |
| Bulk, mils | 20 | 30 |
| Dry Grab Tensile(2), Pounds | | |
| MD | 18 | 16.4 |
| CD | 13 | 11.1 |
| Elongation, % | | |
| MD | 20, dry; 20, wet | 36, dry; 34, wet |
| CD | 80, dry; 60, wet | 88, dry; 70, wet |
| Wet Tensile(2) | | |
| MD | 8.5 | 8.2 |
| CD | 6 | 5.8 |
| Absorbent Capacity, %(3) | 850 | 930 |
| Absorbent Time(3), Sec. | 1.6 | 1.5 |
| Wet Abrasion(4), Cycles Bottom Side | 500 | 479 |

TABLE III-continued

| Property | Example 1 | Example 2 |
|---|---|---|
| Launderability(5), cycles | 25 | 5 |

(1)Standard "Handle-O-Meter" test on a 4-inch square (Ex. 1) or 6-inch square (Ex. 2) sample using a ⅜-inch slot. Machine direction of fabric is perpendicular to slot.

(2)1 × 6 inch (Example 1) or 4 × 6 inch (Example 2) sample tested in an Instron tensile tester at a pull rate of 12 inches per minute. One gripper is 1 inch wide and the other is 1½ inches wide.

(3)Absorbent capacity - A five gram sample of fabric held in a three gram wire basket is immersed in a container of tap water. Absorbent time is the time for the sample to sink. The sample is immersed for 10 more seconds, the basket with the sample is removed and allowed to drip for 10 seconds, and is then weighed. Absorbent capacity is calculated as follows:

$$\frac{\text{wet weight} - \text{dry weight}}{\text{dry weight of fabric}} \times 100$$

(4)Standard abrasion test on a 3 × 9 inch sample, using a 5 pound head weight. "Bottom side" refers to the side adjacent to the forming belt during the water jet entangling step.

(5)Wash durability - each cycle in the wash durability test is a complete agitated wash (for 10 minutes in hot water at about 140° F. containing detergent), rinse (in warm water - about 100° F.), and spin cycle in a Maytag home washing machine containing an eight-pound load of laundry. The fabric is considered to fail when it develops a hole anywhere in the fabric. Two samples of each fabric are used, with the sample size being at least 13 × 18 inches. An accelerated test may be used in order to save time. Instead of 10-minute agitated wash cycles, 2-hour, 4-hour, and 24-hour agitated wash cycles may be used. The results reported in Table III are the equivalent in the standard 10-minute wash cycles.

The fabrics of this invention have an excellent combination of properties that make them useful as wiping cloths. The data presented in Table III, above, illustrate the excellent combination of softness, absorbent capacity, abrasion resistance, and durability (launderability) exhibited by these fabrics. Simulated use testing has demonstrated that the fabrics resist staining by foods such as catsup, mustard, coffee, and greasy materials, so that when the fabrics are used to wipe up such materials, the fabrics rinse clean with little or no residual discoloration. This makes the fabrics excellent for use as wipes in places such as kitchens, restaurants, fast food establishments, and ice cream counters, wherein it is advantageous for the fabrics to remain unstained after repeated uses and rinses.

The absorbent capacity, take-up rate, and the amount of residue left after wiping (or, more precisely, blotting), of the fabrics of Examples 1 and 2 were determined using a gravimetric absorbency tester ("GAT"). The GAT is described in detail in commonly assigned U.S. patent application Ser. No. 149,214, filed on May 12, 1980. Briefly, the GAT is an apparatus for determining the weight and rate of liquid flowing to or from a test site. The apparatus comprises, in combination:

A vessel for containing liquid, said vessel being supported solely by weighing means;

Indicating means for indicating the weight sensed by said weighing means;

A test surface to receive a specimen to be tested, said test surface including said test site;

Conduit means operatively connecting said vessel to said test site for directing a flow of liquid between said vessel and said test site; and Means for vertically positioning said test site.

The liquid used was water, and the test surface used for determining absorbent capacity and take-up or absorbency rate was a flat plate with a point source of liquid connected to the vessel.

To determine the residue left after wiping, the test surface used was a flat glass plate having a 6 centimeter in diameter circular test area circumscribed by a groove in the surface of the glass. A quantity of water equal to 50 percent of the calculated absorbent capacity of the specimen to be tested was placed in the test area. The specimen (10 centimeters in diameter), mounted on a flat, circular specimen holder 8 centimeters in diameter was brought into contact with the test area containing the water. A contact pressure of about 3.5 grams/cm$^2$ was used, and the contact time was about 30 seconds. The test specimen was then removed, and the weight of the residue was determined.

The results of these three tests are shown below in Table IV:

TABLE IV

| | Absorbent Capacity % (Weight of water absorbed divided by weight of fabric) | Absorbency Rate-gm/gm/sec | Residue, gm. |
|---|---|---|---|
| Example 1 | 660 | 0.11 | 0.01 |
| Example 2 | 790 | 0.11 | 0.01 |

For comparison purposes, the tested values for several other types of wipes are displayed below in Table V:

TABLE V

| | Absorbent Capacity % | Absorbency Rate-gm/gm/sec | Residue, gm. |
|---|---|---|---|
| Paper Towel (Bounty) | 880 | 0.17 | 0.04 |
| Woven Terry Towel | 485 | 0.07 | 0.02 |
| Scott Paper (Toilet tissue) | 690 | 0.13 | 0.23 |

EXAMPLES 3 AND 4

By a procedure similar to that described in Examples 1 and 2 (with the differences discussed below), two fabrics were made from blends of 70 weight percent Enka 8172 rayon staple (1¼ inches; 1.5 denier) and 30 weight percent Celanese Fortrel Type 310 polyester staple. The total weight of the web was 600±10% grains per square yard.

Two different forming belts were used. Both were plain 1×1 single layer weaves woven of monofilament. The thread counts and monofilament sizes were as follows:

TABLE VI

| | Warp | | Shute | |
|---|---|---|---|---|
| | Threads per inch | Filament Diameter, mils | Threads per inch | Filament Diameter, mils |
| Example 3 | 12 | 28 | 12 | 28 |
| Example 4 | 22 | 20 | 24 | 17 |

All the threads were polyester monofilaments, except for the shute in Example 4, which was stainless steel.

The conditions under the water jets were similar to that of Example 1, except that only 6 instead of 9 strips at 600 psi were used.

After dewatering, the web was passed over two stacks of steam cans operated at 20 and 40 psi, respectively.

The dried web was then run through a bonding station that differed from the padder shown in FIG. 1 in the following respects:

The pick-up roll was an engraved steel roll engraved with a pattern of 23 continuous lines per inch. The lines were inclined 15° from the long axis of the roll. Each line was 4 mils deep and 18 mils wide. The top roll had a hard rubber face and it was wrapped with a ¾-inch thick layer of open celled urethane foam. The two rolls were stopped to a gap of 1 or 2 mils. A doctor blade was used to wipe excess binder formulation from the pick-up roll. The following binder formulation was applied:

TABLE VII

| Component | Weight, pounds |
|---|---|
| Water | 434.7 |
| Diammonium Phosphate | 0.75 |
| Anti-foam agent (y-30) | 0.01 |
| Acrylic resin latex[1] | 14.85 |
| Deceresol OT | 0.45 |

[1]Rohm & Haas HA-8

Wet pick-up was 100 weight percent. The fabric was then dried by passing over two stacks of steam cans operated at 40 psi. The finished fabric had a binder content of about 1.5 weight percent, based on weight of fibers plus binder, with the binder being distributed substantially uniformly throughout the webs.

The two fabrics had very similar physical properties. Representative physical properties are shown below in Table VIII:

TABLE VIII

| | |
|---|---|
| Weight, grains/yd | 612 |
| Bulk, mils | 80 |
| Softness, grams | 24 |
| Dry Tensile, Pounds | |
| MD | 15 |
| CD | 11 |
| Wet Tensile, Pounds | |
| MD | 12 |
| CD | 8 |
| Dry Elongation, % | |
| MD | 30 |
| CD | 85 |
| Absorbent Capacity, % | 660 |
| Absorbent Time, seconds | 1.5 |

(The tensile tests were carried out on 4× 6 inch samples.)

Figure 4:
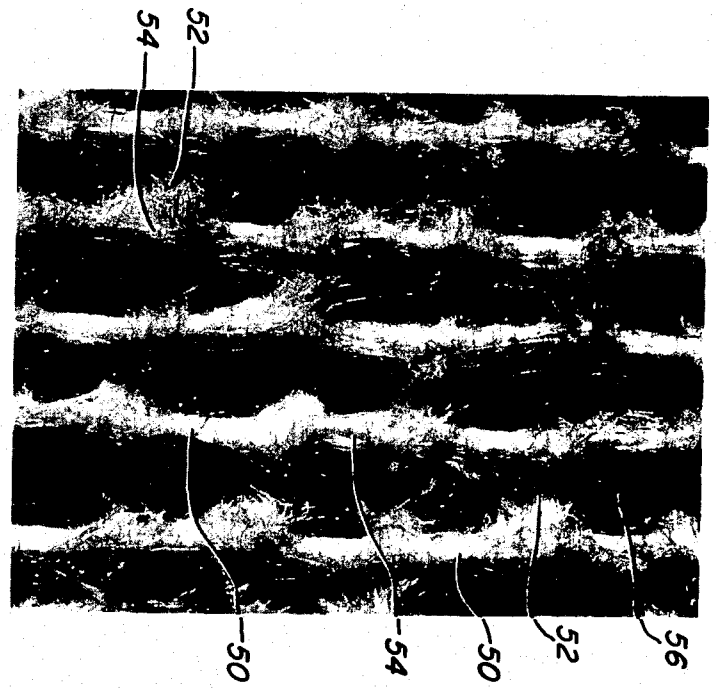
FIGS. 4 and 5 are photomacrographs, originally taken at 10×, of the fabric of Example 3.
Figure 5:
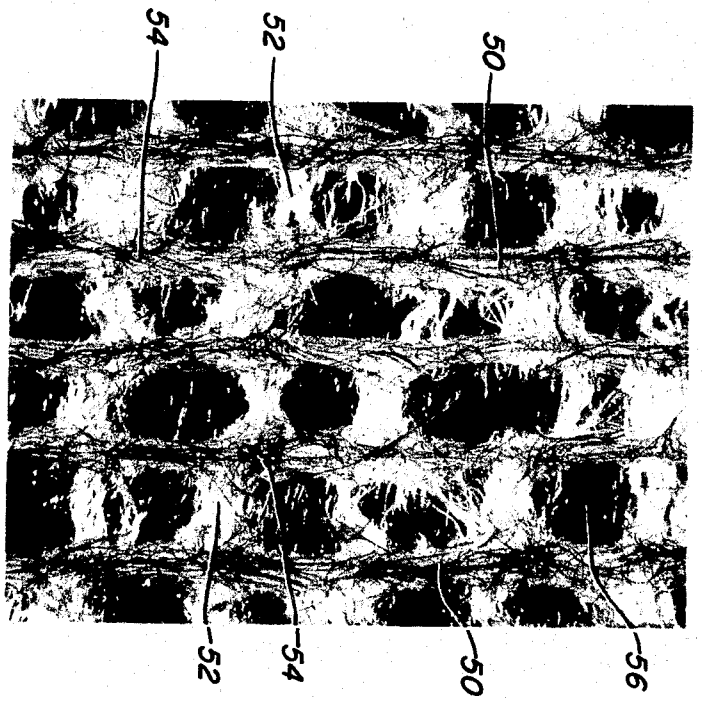
Figure 6:
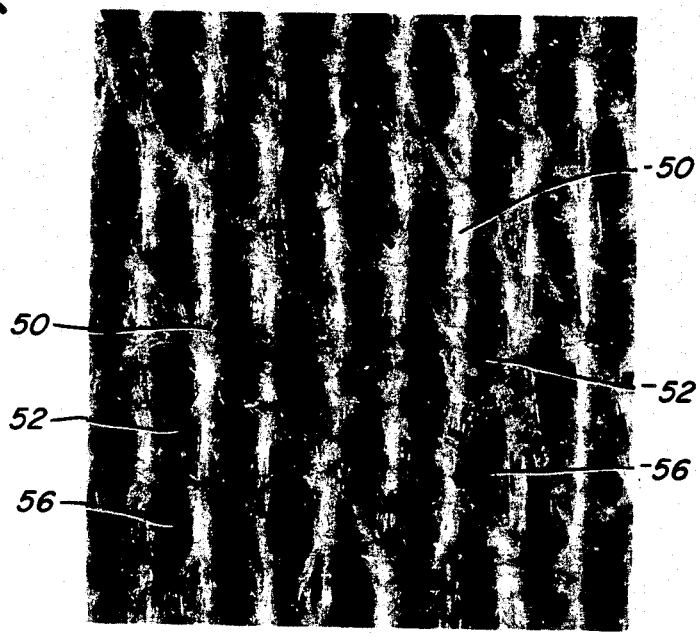
FIGS. 6 and 7 are photomacrographs, originally taken at 10×, of the fabric of Example 4.
Figure 7:
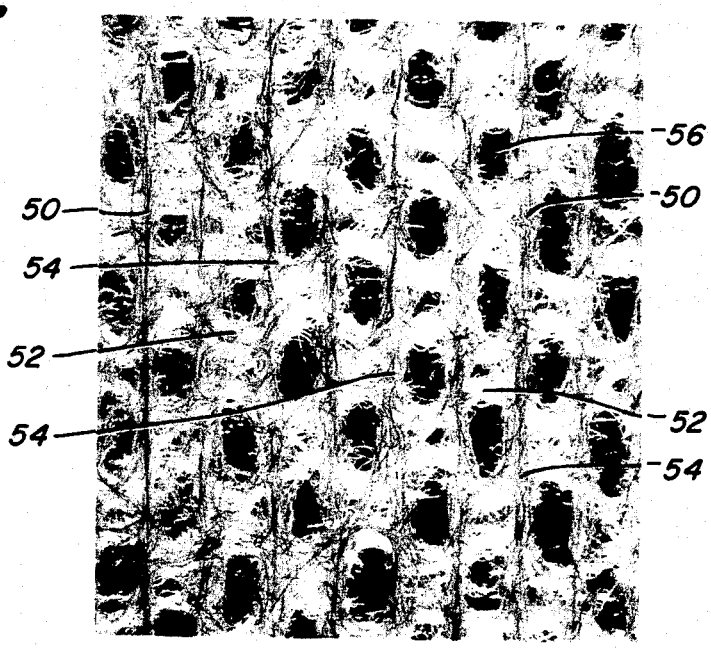

FIGS. 4 and 5 show the fabric of Example 3 and FIGS. 6 and 7 shows the fabric of Example 4. As can best be seen in FIGS. 5 and 7, which were taken with transmitted light, the fabrics have the same basic morphology as the fabric of Example 2, differing only in scale.

EXAMPLE 5

Avtex SN 1913, 1.5 denier, 19/16" staple rayon was processed through an opener/blender and fed to a random air laying unit, which deposited 1525±15% grains per square yard web onto a forming belt. The forming belt was woven of 0.040 inch polyester monofilaments in a plain 1×1 single layer weave, having 6 warps per inch and 6 chutes per inch.

Using an apparatus similar to that shown in FIG. 1, the web was passed under seven orifice strips, each of which contained a row of holes, 30 holes per inch, of 0.007 inch diameter. Water was jetted through the strips at 100 psi for the first strip and 600 psi for the remaining six strips.

After dewatering, the web was passed over steam heated dry cans operating at 250° F. The dried web was then passed through a printing station wherein binder is added to both sides of the web in a 6 line diamond pattern. Each line of the pattern on the print roll is 0.018 inches wide and 0.005 inches deep. The printed web is then redried over steam cans operating at 250° F. 150 gr. binder was added per yard width of the web, resulting in a final fabric weight of 1675 gr./yd. The binder used was formulated as follows:

TABLE IX

| Component | Weight |
|---|---|
| Water | 4.0 lb. |
| Self-crosslinking Acrylic resin[1] | 11.6 lb. |
| Antifoam Agent | 0.042 lb. |
| Wetting Agent[2] | 0.27 lb. |
| Diammonium Phosphate | 0.003 lb. |

[1]B. F. Goodrich Hycar 2671, 50% solids
[2]American Cyanamid OT

Figure 8:
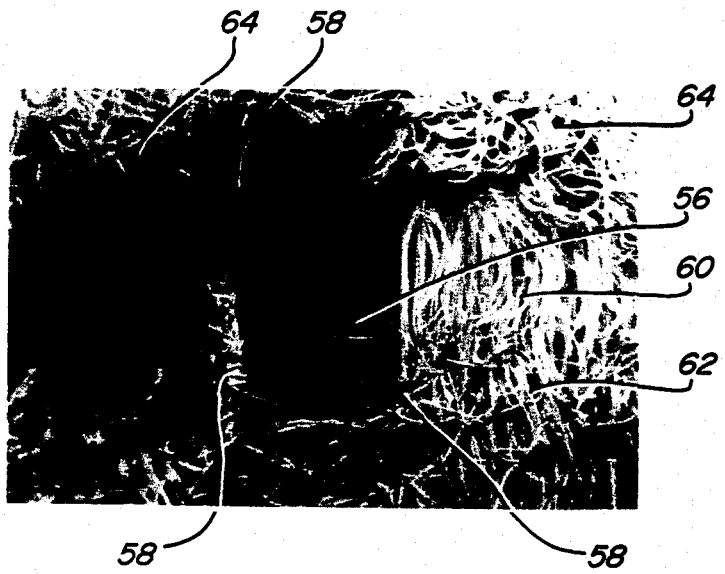
FIG. 8 is a photomacrograph, originally taken at 20×, of the fabric of Example 5.
Figure 9:
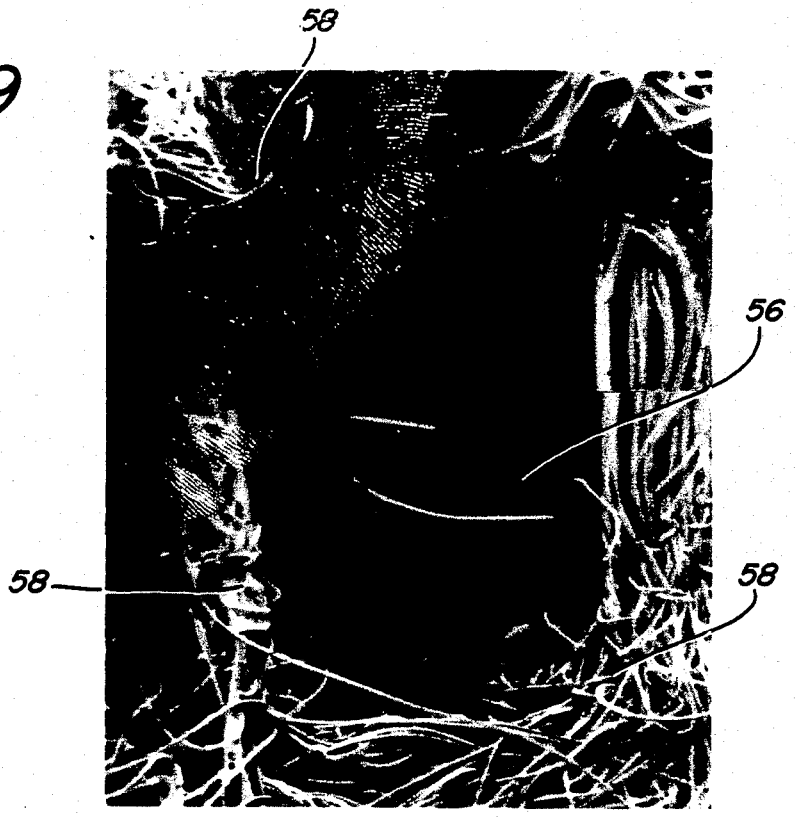
FIG. 9 is a photomacrograph, originally taken at 50×, of the fabric of Example 5.
Figure 10:
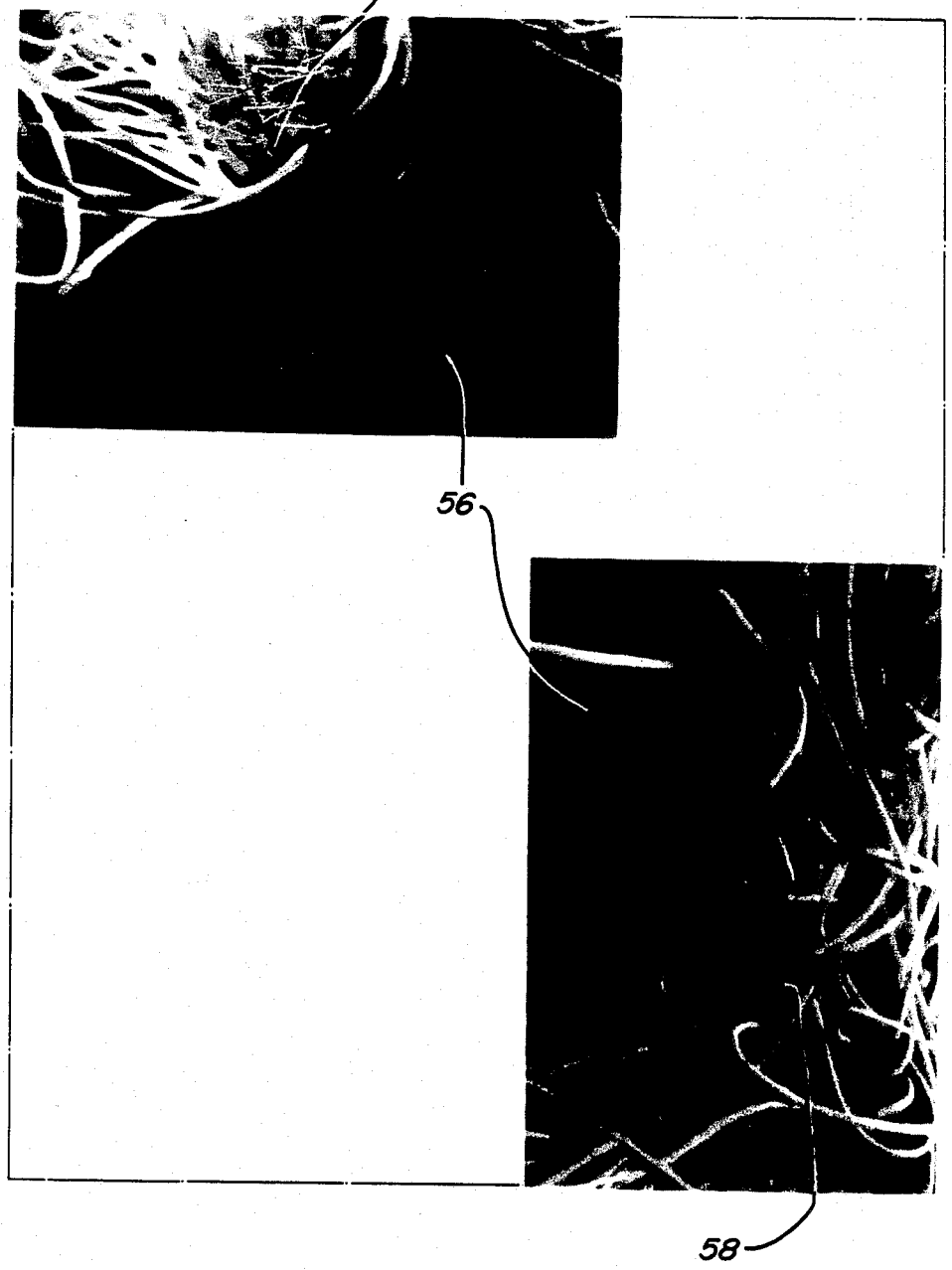
FIG. 10 is a partial representation of the fabric of Example 5, using photomacrographs originally taken at 100×.

The construction of the fabric is shown in FIGS. 8–10. The fabric, as shown especially in FIG. 8, has a series of bands, 60 and 62, that are substantially perpendicular to each other. Each band, in both series, contains segments in which the fibers are substantially parallel to each other, which segments alternate with regions 64 in which the fibers are randomly entangled at the intersections of the bands. At regularly spaced intervals between the bands there are openings 56 in the fabric.

FIGS. 9 and 10 illustrate, at greater magnification, the area of the fabric of FIG. 8, about the opening 56, to illustrate regions of intense entangling or knotting 58 about the periphery of the opening 56. The fiber knots in the regions 58 lend strength to the overall fabric and serve to strengthen and maintain the openings.

What is claimed is:

1. A nonwoven fabric comprising a substantially isotropic web comprising at least 70% rayon staple fibers characterized by said web having regions wherein the fibers of the web have been lightly entangled by the action of columnar jets of fluid, and said web containing a small amount of adhesive binder substantially uniformly distributed throughout said web, the amount of binder being sufficient to resist wet collapse of said web, and said fabric having an excellent balance of wiping properties, abrasion resistance, and softness; said fabric comprising two series of fibrous bands that are substantially perpendicular to each other, wherein each band in both series contains segments in which the individual fibers are all substantially parallel to each other, which segments alternate with regions in which the fibers have been randomly entangled, said regions occurring where an individual band of one series intersects an individual band of the other series, and wherein at regularly spaced intervals between the individual bands of both of said series there are openings in said fabric.

2. The nonwoven fabric of claim 1, having regions about the openings, wherein the fibers are knotted together.

3. A nonwoven fabric comprising a substantially isotropic web comprising at least 70% rayon staple fibers characterized by said web having regions wherein the fibers of the web have been lightly entangled by the action of columnar jets of fluid and said web containing a small amount of adhesive binder substantially uniformly distributed throughout said web, the amount of binder being sufficient to resist wet collapse of said web, and said fabric having an excellent balance of wiping properties, abrasion resistance, and softness; said fabric comprising a series of parallel fibrous bands interconnected by a series of generally parallel sepentine fibrous bands, each such serpentine band curving according to the mirror image of its next adjacent band, wherein each band of both series contains segments in which lengths of the individual fibers are disposed in a linear or a curvilinear unentangled manner, which segments alternate with regions in which the fibers have been randomly entangled, said regions occurring where an individual band of one series intersects an individual band of the other series and wherein at regularly spaced intervals between the individual bands of both of said series there are rounded openings in said fabric.

4. The fabric of claim 1 wherein the binder content is within the range of from about 0.8 to 10 weight percent, based on weight of fibers plus binder.

5. The fabric of claim 3 wherein the binder is an acrylic latex polymer.

* * * * *